US011913717B2

(12) United States Patent
Yamada et al.

(10) Patent No.: US 11,913,717 B2
(45) Date of Patent: Feb. 27, 2024

(54) NATURAL GAS LIQUEFYING APPARATUS

(71) Applicant: JGC CORPORATION, Kanagawa (JP)

(72) Inventors: Yoshinori Yamada, Kanagawa (JP); Kaoru Sawayanagi, Kanagawa (JP); Tomoharu Inoue, Kanagawa (JP); Yuichi Yoshizawa, Kanagawa (JP); Masahito Seiwa, Kanagawa (JP); Ken Ichimura, Kanagawa (JP)

(73) Assignee: JGC CORPORATION, Kanagawa (JP)

( * ) Notice: Subject to any disclaimer, the term of this patent is extended or adjusted under 35 U.S.C. 154(b) by 0 days.

(21) Appl. No.: 17/639,588

(22) PCT Filed: Oct. 29, 2019

(86) PCT No.: PCT/JP2019/042391
§ 371 (c)(1),
(2) Date: Mar. 2, 2022

(87) PCT Pub. No.: WO2021/084621
PCT Pub. Date: May 6, 2021

(65) Prior Publication Data

US 2022/0290918 A1 Sep. 15, 2022

(51) Int. Cl.
*F25J 1/02* (2006.01)
*F25J 1/00* (2006.01)

(52) U.S. Cl.
CPC ..... *F25J 1/0022* (2013.01); *F25J 1/0214* (2013.01); *F25J 1/0215* (2013.01); *F25J 1/0259* (2013.01);
(Continued)

(58) Field of Classification Search
None
See application file for complete search history.

(56) References Cited

U.S. PATENT DOCUMENTS

2016/0010916 A1* 1/2016 Byfield ..... F28B 1/06 62/611
2017/0160009 A1* 6/2017 Takezawa ..... F25J 1/0087
(Continued)

FOREIGN PATENT DOCUMENTS

JP 2005147568 6/2005
JP 4912564 4/2012
(Continued)

OTHER PUBLICATIONS

"International Search Report (Form PCT/ISA/210) of PCT/JP2019/042391," dated Feb. 4, 2020, with English translation thereof, pp. 1-4.

*Primary Examiner* — Brian M King
(74) *Attorney, Agent, or Firm* — JCIPRNET

(57) ABSTRACT

A natural gas liquefying apparatus includes: a precooling unit, which is a treatment unit configured to precool natural gas; a liquefying unit, which is a treatment unit configured to liquefy the natural gas; a refrigerant cooling unit, which is a treatment unit configured to cool a liquefying refrigerant; a compression unit configured to compress vaporized refrigerants; and a pipe rack including air-cooled coolers arrayed and arranged on an upper surface. The treatment units and the compression unit are separately arranged in a first arrangement region and a second arrangement region arranged opposed to each other across a long side of the pipe rack. The pipe rack interposed between the first and second arrangement regions has a region in which no air-cooled cooler is arranged in order to arrange a plurality of pipes, through which refrigerants are allowed to flow, in a direction of a short side of the pipe rack.

4 Claims, 7 Drawing Sheets

(52) U.S. Cl.
CPC ..... *F25J 1/0275* (2013.01); *F25J 1/0278* (2013.01); *F25J 2290/42* (2013.01); *F25J 2290/50* (2013.01)

(56) References Cited

U.S. PATENT DOCUMENTS

| | | | | |
|---|---|---|---|---|
| 2020/0116426 | A1* | 4/2020 | Kobayashi | F25J 1/0296 |
| 2020/0309450 | A1* | 10/2020 | Morley | F25J 1/0244 |

FOREIGN PATENT DOCUMENTS

| | | |
|---|---|---|
| JP | 2016038193 | 3/2016 |
| JP | 2018531355 | 10/2018 |
| WO | 2016001952 | 1/2016 |

* cited by examiner

NATURAL GAS LIQUEFYING APPARATUS

CROSS-REFERENCE TO RELATED APPLICATION

This application is a 371 application of the International PCT application serial no. PCT/JP2019/042391, filed on Oct. 29, 2019. The entirety of the above-mentioned patent application is hereby incorporated by reference herein and made a part of this specification.

TECHNICAL FIELD

The present invention relates to a natural gas liquefying apparatus configured to liquefy natural gas by cooling the natural gas through use of a refrigerant.

DESCRIPTION OF THE RELATED ART

A natural gas liquefying apparatus (NG liquefying apparatus) is configured to liquefy natural gas (NG) produced from, for example, a gas well by cooling the natural gas, to thereby produce liquefied natural gas (LNG).

As described in, for example, Patent Document 1, the NG liquefying apparatus includes devices such as a precooling heat exchanger for precooling the natural gas, and a cryogenic heat exchanger for liquefying the natural gas. The NG is allowed to flow through the devices via pipes connected between the devices, and is sequentially subjected to treatments. Further, the precooling heat exchanger and the cryogenic heat exchanger are each configured to cool the NG through heat exchange using a refrigerant, and are configured to allow the refrigerants to flow through the devices via pipes provided between the heat exchangers and compressors for compressing the refrigerants used for heat exchange. For the NG liquefying apparatus including a large number of devices in addition to the above-mentioned devices, there is a demand to pursue device arrangement capable of reducing amounts of materials such as pipe forming members to be used as much as possible.

RELATED ART DOCUMENTS

Patent Documents

Japanese Patent No. 4912564

SUMMARY OF THE INVENTION

Problem to be Solved

The present invention has been made in view of such circumstances, and has an object to provide a natural gas liquefying apparatus reduced in amounts of materials to be used and amount of construction work.

Means for Solving Problem

According to the present invention, there is provided a natural gas liquefying apparatus for liquefying natural gas, including:

a precooling unit, which is a treatment unit including a precooling heat exchanger configured to precool, through use of a precooling refrigerant, the natural gas supplied to the natural gas liquefying apparatus;

a liquefying unit, which is a treatment unit including a liquefying heat exchanger configured to liquefy the precooled natural gas through use of a liquefying refrigerant;

a compression unit including:

a first compressor configured to compress the vaporized precooling refrigerant; and a second compressor configured to compress the vaporized liquefying refrigerant;

a pipe rack, which is a framework structure having a rectangular shape in top view, and is configured to retain a plurality of pipes through which a fluid to be treated in the natural gas liquefying apparatus is allowed to flow, the pipe rack including a plurality of air-cooled coolers arrayed and arranged on an upper surface of the pipe rack, the plurality of air-cooled coolers being configured to cool a fluid to be cooled that includes the precooling refrigerant compressed by the first compressor, and the liquefying refrigerant compressed by the second compressor; and a refrigerant cooling unit, which is a treatment unit including a refrigerant cooling heat exchanger configured to cool, through use of the precooling refrigerant, the liquefying refrigerant cooled by the plurality of air-cooled coolers, wherein the treatment units and the compression unit are arranged in a first arrangement region and a second arrangement region with any one of combinations (a), (b), and (c):

(a) the compression unit and at least one treatment unit selected from a treatment unit group consisting of the precooling unit, the liquefying unit, and the refrigerant cooling unit are arranged in the first arrangement region, and the other treatment units that are not arranged in the first arrangement region are arranged in the second arrangement region;

(b) the compression unit is arranged in the first arrangement region, and the precooling unit, the liquefying unit, and the refrigerant cooling unit are arranged in the second arrangement region; and (c) the first compressor of the compression unit, a driver for the first compressor, and the precooling unit are arranged in the first arrangement region, the second compressor of the compression unit, a driver for the second compressor, and the liquefying unit are arranged in the second arrangement region, and the refrigerant cooling unit is arranged in any one of the first arrangement region and the second arrangement region, wherein at least a part of the first arrangement region and at least a part of the second arrangement region are arranged so as to be opposed to each other across a long side of the rectangular shape of the pipe rack, and wherein the pipe rack interposed between the first arrangement region and the second arrangement region has a region in which no air-cooled cooler is arranged in order to arrange a plurality of pipes, through which one of the precooling refrigerant and the liquefying refrigerant is allowed to flow, in a direction of a short side of the rectangular shape of the pipe rack.

The natural gas liquefying apparatus may have the following features.

(1) In the region in which no air-cooled cooler is arranged, the plurality of pipes are separately arranged in a plurality of stages within a height range corresponding to a range from a cooling-air intake space to arrangement positions of the plurality of air-cooled coolers in a region in which the plurality of air-cooled coolers are arranged.

(2) A top plate configured to cover the plurality of pipes from an upper surface side of the pipe rack is arranged in the region in which no air-cooled cooler is arranged.

(3) When the combination in the first arrangement region and the second arrangement region satisfies one of the combination (a) and the combination (b), the first compressor and the second compressor are configured to be driven by a shared driver. Further, when the combination in the first arrangement region and the second arrangement region satisfies the combination (a), two compression units are provided, and the two compression units are arranged such that the at least one treatment unit arranged in the first arrangement region is placed between the two compression units.

According to the present invention, the first arrangement region and the second arrangement region, in which the treatment units and the compression unit to be connected to each other via the large-diameter pipes, are arranged so as to be opposed to each other across the pipe rack. With this arrangement, an installation length of the large-diameter pipes can be reduced. Moreover, the pipe rack has the region in which no air-cooled cooler is arranged, and, for example, the above-mentioned large-diameter pipes are arranged so as to cross the region. With this configuration, increase in height of the entire pipe rack can be suppressed.

DESCRIPTION OF THE EMBODIMENTS

Figure 1:
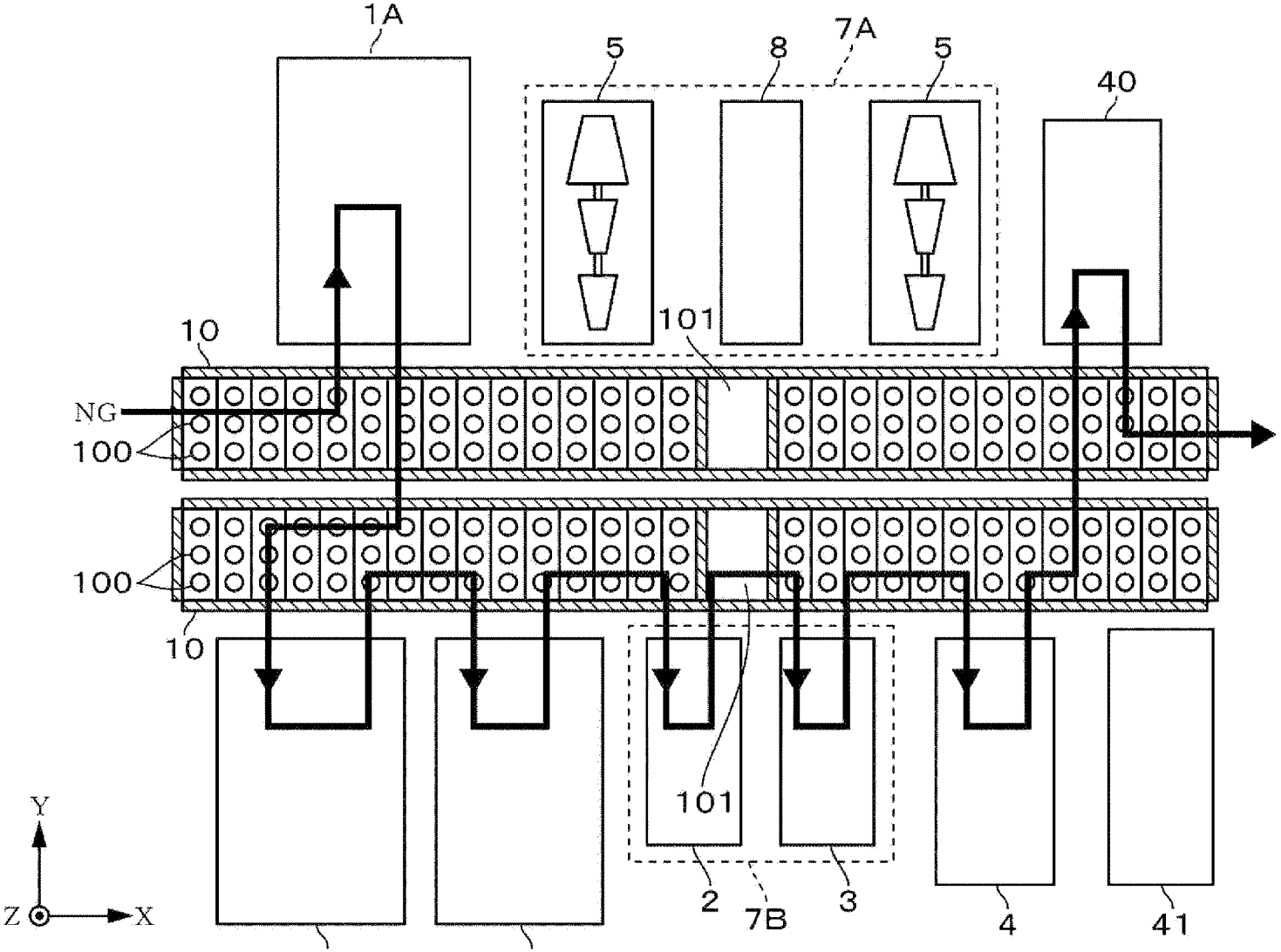
FIG. 1 is a plan view for illustrating an overall configuration of an NG liquefying apparatus according to an embodiment of the present invention.

A basic configuration of a natural gas (NG) liquefying apparatus according to this embodiment is described with reference to FIG. 1. The NG liquefying apparatus includes hot sections 1A and 1B configured to perform a pretreatment, specifically, removal of various kinds of impurities such as mercury, acid gases (for example, hydrogen sulfide, mercaptan, and carbon dioxide), water, and heavy components that are included in an NG produced from a wellhead. The NG liquefying apparatus further includes a heavy-component removing unit 20, a precooling unit 2, and a liquefying unit 3. The heavy-component removing unit 20 is configured to separate heavy components from the NG that has been subjected to the pretreatment. The precooling unit 2 is configured to precool the NG, from which the heavy components are removed, to about −35° C. The liquefying unit 3 is configured to liquefy the precooled NG by cooling the NG from −35° C. to a range of from −100° C. to −120° C. The NG liquefying apparatus according to this embodiment further includes a subcooling unit 4 and an end flash unit 40. The subcooling unit 4 is configured to subcool the LNG subjected to liquefaction to a range of from −150° C. to −156° C. The end flash unit 40 is configured to adiabatically expand part of the subcooled LNG and decrease a temperature of the LNG to a range of from about −159° C. to about −162° C., thereby obtaining a liquid LNG under the normal pressure.

The units forming the NG liquefying apparatus (specifically, the hot sections 1A and 1B, the precooling unit 2, the heavy-component removing unit 20, the liquefying unit 3, the subcooling unit 4, and the end flash unit 40) include a large number of devices (device groups) including, for example, static devices such as column towers, tanks, and heat exchangers, dynamic devices such as pumps, and connection pipes connecting the static devices and the dynamic devices to each other. The device groups are collected in the units, respectively, and are arranged in a multi-story framework having a framed structure.

Figure 2:
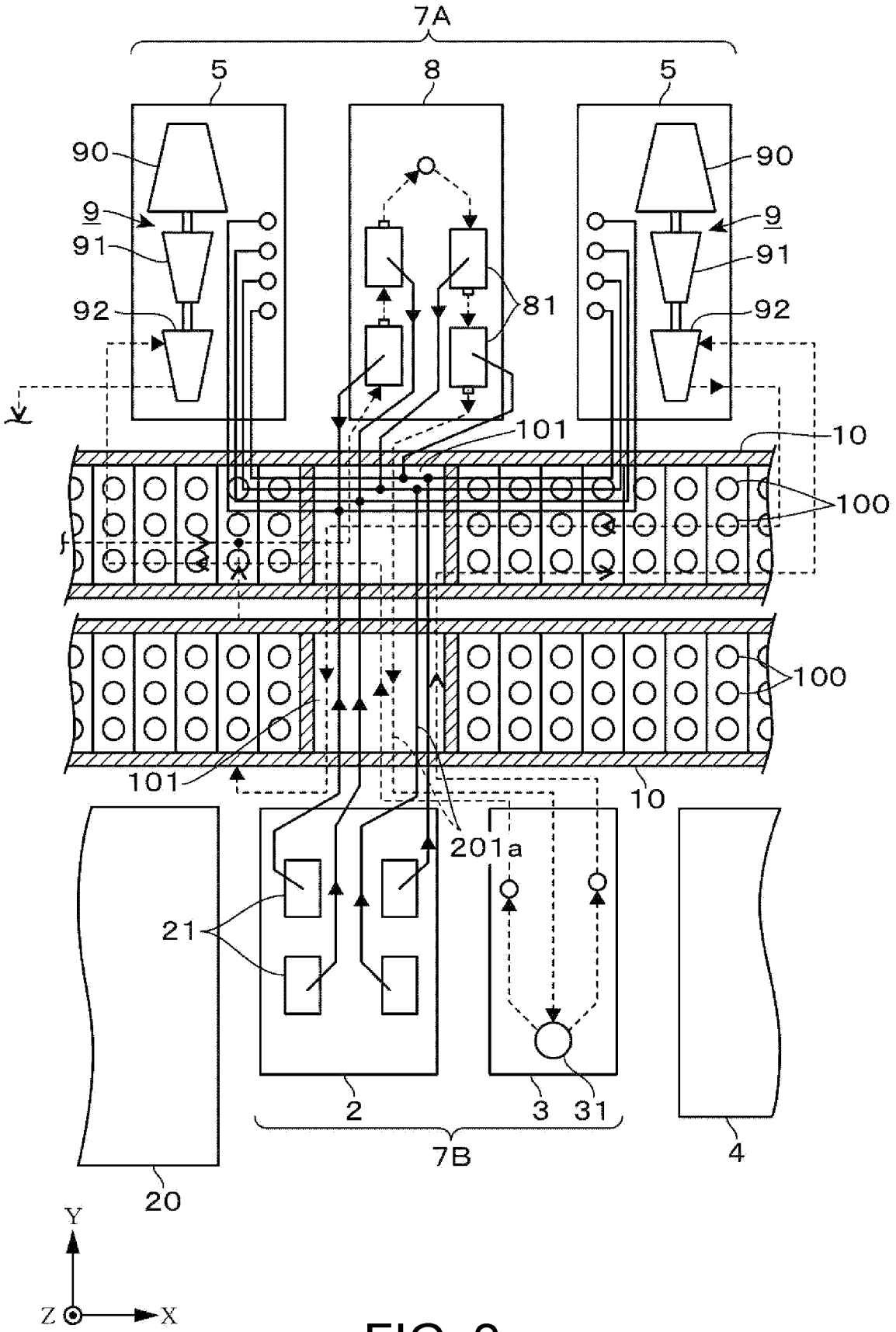
FIG. 2 is an enlarged plan view for illustrating a first arrangement region and a second arrangement region.

The precooling unit 2 includes a heat exchanger (precooling heat exchanger 21 illustrated in an enlarged view of FIG. 2) configured to precool the NG through use of a precooling refrigerant. Further, the NG liquefying apparatus includes first compressors 91 and a plurality of air-cooled coolers (ACHEs: air-cooled heat exchangers) 100. The first compressors 91 are configured to compress the precooling refrigerant vaporized by the precooling unit. The plurality of air-cooled coolers 100 are configured to cool the compressed precooling refrigerant.

Further, the liquefying unit 3 includes a heat exchanger (cryogenic heat exchanger (or main cryogenic heat exchanger (MCHE) 31) illustrated in an enlarged view of FIG. 2) configured to liquefy the NG through use of a liquefying refrigerant. Further, the NG liquefying apparatus includes second compressors 92 and the plurality of ACHEs 100. The second compressors 92 are configured to compress the vaporized liquefying refrigerant. The plurality of ACHEs 100 are configured to cool the compressed liquefying refrigerant.

The subcooling unit 4 includes a heat exchanger (subcooling heat exchanger (not shown)) configured to subcool the NG through use of a subcooling refrigerant. Further, the NG liquefying apparatus includes third compressors 41 and the plurality of ACHEs 100. The third compressors 41 are configured to compress the subcooling refrigerant. The plurality of ACHEs 100 are configured to cool the compressed subcooling refrigerant.

In this embodiment, the first compressor 91 and the second compressor 92 form a gas turbine compressor 9 to be driven by a shared driver (gas turbine) 90. Further, in the NG liquefying apparatus, two gas turbine compressors 9 are provided. Only one gas turbine compressor 9 may be provided, and the first compressor 91 and the second compressor 92 may be driven by separate drivers, respectively. Further, the driver can be formed of a motor. The gas turbine compressor 9 and its accessory devices correspond to a compression unit 5 in this embodiment.

Further, the NG liquefying apparatus according to this embodiment includes a refrigerant cooling unit 8 provided with a liquefying-refrigerant/precooling-refrigerant heat exchanger (hereinafter, also referred to as "refrigerant cooling heat exchanger 81") configured to further cool, through use of the above-mentioned precooling refrigerant, the liquefying refrigerant cooled by the ACHES 100.

As described above, the NG liquefying apparatus according to this embodiment is configured to produce the LNG through use of three kinds of refrigerants. As examples of the refrigerants, there can be given a case in which propane is used as the precooling refrigerant, a mixed refrigerant (MR) obtained by mixing, for example, nitrogen, methane, ethane, and propane is used as the liquefying refrigerant, and nitrogen is used as the subcooling refrigerant.

Figure 3:
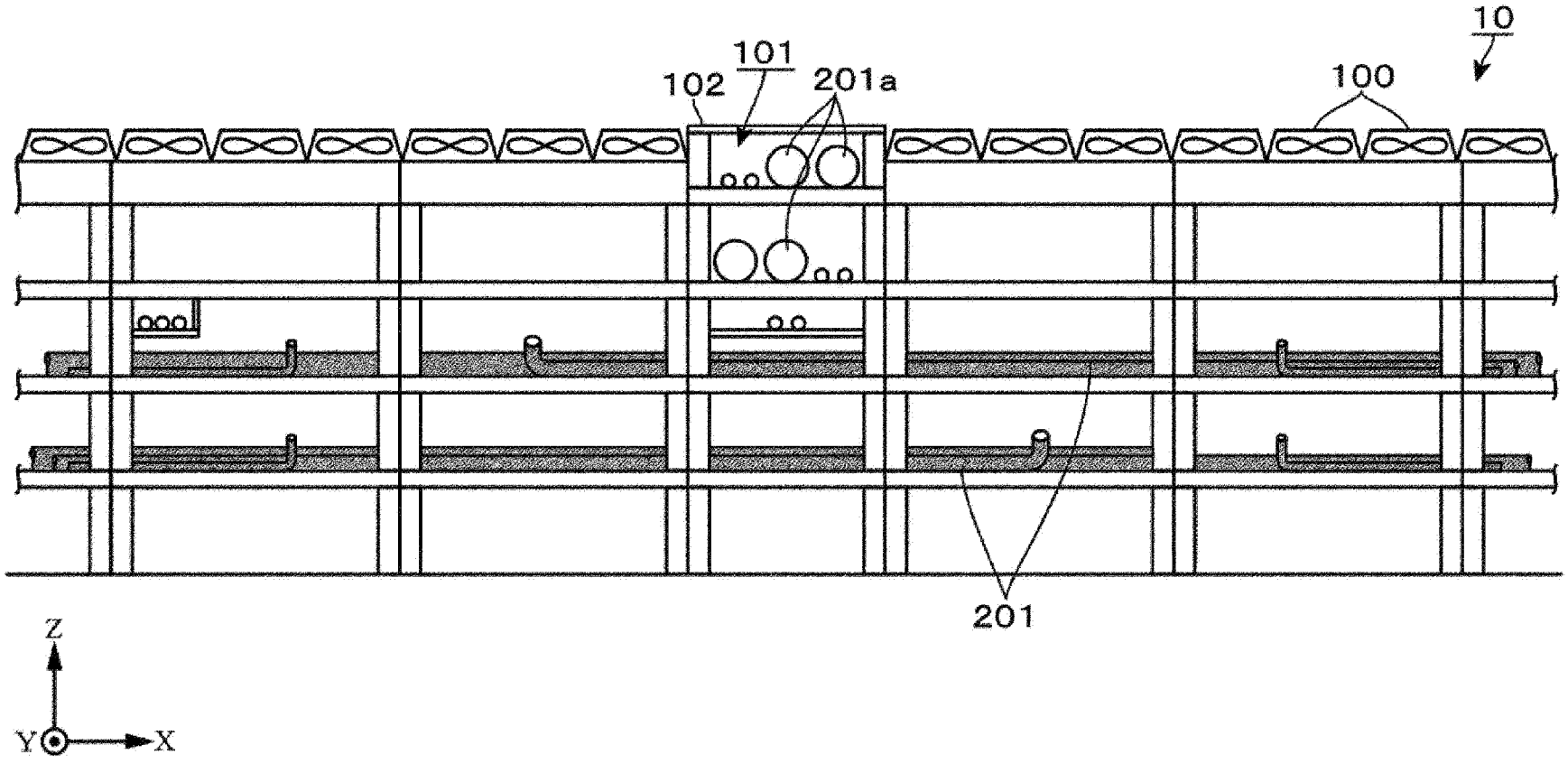
FIG. 3 is a side view for illustrating a pipe rack.

Further, the NG liquefying apparatus includes pipe racks 10. As illustrated in FIG. 1, the pipe racks 10 are each formed of a framework having a rectangular shape in top view, and each have a plurality of stories, for example, a three-story structure as illustrated in FIG. 3. On the stories of the pipe racks 10, there are provided pipes 201 through which the NG is transferred among the units configured to treat the NG, the heat exchangers (such as the precooling heat exchanger 21 and the MCHE 31), and pipes 201*a* (hereinafter, also referred to as "crossing pipes 201*a*") through which the refrigerants are allowed to flow among the compressors 91, 92, and 41 and the ACHEs 100. Arrangement states of the pipes 201 and 201*a* are described later.

As illustrated in, for example, FIG. 1, in the NG liquefying apparatus according to this embodiment, for example, the two pipe racks 10 are arranged side by side so that long sides of the two pipe racks 10 are oriented in the same direction.

Further, on upper surfaces of the pipe racks 10, a large number of ACHEs 100 are arrayed and arranged so as to have rectangular shapes in top view. The ACHEs 100 are configured to cool various kinds of fluids including the above-mentioned compressed precooling refrigerant, liquefying refrigerant, and subcooling refrigerant. In FIG. 1, FIG. 2, and FIG. 4 to FIG. 7, circles illustrated in the line frames indicating the pipe racks 10 schematically indicate the ACHEs 100.

As schematically illustrated in FIG. 3, the ACHEs 100 are configured to take in the air through use of a rotary fan from air inlet ports formed on lower sides of the ACHEs 100 (lower sides of the upper surfaces of the pipe racks), and discharge the air through air outlet ports formed so as to extend upward. The cooling air is supplied to a tube bundle (not shown) obtained by bundling tubes through which a fluid to be cooled flows, thereby being capable of cooling the fluid to be cooled supplied into the ACHEs 100.

The NG liquefying apparatus includes, in addition to a power generation turbine, a power generator, or a power source for the turbine, utility device groups including, for example, a boiler configured to generate steam being a heat source for a fractionator provided in the heavy-component removing unit 20 or a heating system configured to heat a heat medium such as hot water or hot oil. In FIG. 1, FIG. 2, and FIG. 4 to FIG. 7, illustrations of the utility device groups are omitted.

Arrangement of the units of the NG liquefying apparatus according to this embodiment is described. As illustrated in FIG. 1, at substantially a center of the NG liquefying apparatus, the two pipe racks 10 are arranged side by side so that the long sides of the two pipe racks 10 are oriented in the same direction. Along the long side of one pipe rack 10, from one end side to another end side of the one pipe rack 10, one hot section 1A of the two hot sections, one gas turbine compressor 9, the refrigerant cooling unit 8, another gas turbine compressor 9, and the end flash unit 40 are provided in the stated order. Further, along the long side of another pipe rack 10, from one end side to another end side of the another pipe rack 10, the other hot section 1B, the heavy-component removing unit 20, the precooling unit 2, the liquefying unit 3, the subcooling unit 4, and the third compressor 41 are provided in the stated order.

In the NG liquefying apparatus according to the embodiment illustrated in FIG. 1, a region in which two compression units 5 each including the gas turbine compressor 9, and the refrigerant cooling unit 8 are arranged corresponds to a first arrangement region 7A in this embodiment. Further, a region in which the precooling unit 2 and the liquefying unit 3 are arranged corresponds to a second arrangement region 7B in this embodiment. At least a part of the first arrangement region 7A and at least a part of the second arrangement region 7B are provided so as to be opposed to each other across the long sides of the pipe racks 10.

In FIG. 1, regarding the NG liquefying apparatus in which the units are arranged as exemplified above, a schematic flow of a fluid to be processed (NG or LNG subjected to liquefaction) is indicated by the solid arrows. For example, the NG produced from a wellhead is treated while flowing through the hot sections 1A and 1B, the heavy-component removing unit 20, the precooling unit 2, the liquefying unit 3, the subcooling unit 4, and the end flash unit 40 in the stated order via the pipes 201 that bridges laterally across the pipe racks 10, and then flows out of the NG liquefying apparatus as the LNG. The treatment flow of the NG is not limited to the example described above. For example, in some cases, after the NG is precooled by the precooling unit 2, heavy components may be separated by the heavy-component removing unit 20.

Further, in FIG. 2, part of schematic flow paths of the precooling refrigerant and the liquefying refrigerant in the NG liquefying apparatus is indicated by the arrows. The solid arrows indicate a flow of the precooling refrigerant. The dot-dash line arrows indicate a flow of the liquefying refrigerant.

The precooling refrigerant is supplied to each of the precooling heat exchanger 21 of the precooling unit 2 and the refrigerant cooling heat exchanger 81 of the refrigerant cooling unit 8 so as to be used for precooling of the NG and cooling of the liquefying refrigerant. The precooling refrigerant is vaporized through heat exchange in the precooling heat exchanger 21 and the refrigerant cooling heat exchanger 81, and then is supplied to the two first compressors 91 in parallel. After the vaporized precooling refrigerant is compressed by the first compressors 91, the vaporized precooling refrigerant is supplied to the pipe racks 10, and is cooled, liquefied, and subcooled by the ACHEs 100. After that, the cooled precooling refrigerant is supplied to each of the precooling heat exchanger 21 and the refrigerant cooling heat exchanger 81 again.

Further, the liquefying refrigerant to be used in the liquefying unit 3 is vaporized through heat exchange in the MCHE 31 of the liquefying unit 3, and then is supplied to the two second compressors 92 in parallel. The liquefying refrigerant increased in pressure by the second compressors 92 is supplied to the pipe rack 10, and is cooled by the ACHEs 100. The liquefying refrigerant cooled by the ACHEs 100 is further liquefied by the refrigerant cooling unit 8, and is supplied to the MCHE 31.

Although not shown in FIG. 2, the subcooling refrigerant to be used in the subcooling unit 4 exchanges heat in the subcooling heat exchanger (not shown) of the subcooling unit 4, and then is supplied to the third compressor 41. When the subcooling refrigerant increased in pressure by the third compressor 41 is supplied to the pipe rack 10, the subcooling refrigerant is cooled by the ACHEs 100, and is supplied to the subcooling heat exchanger again.

Figure 7:
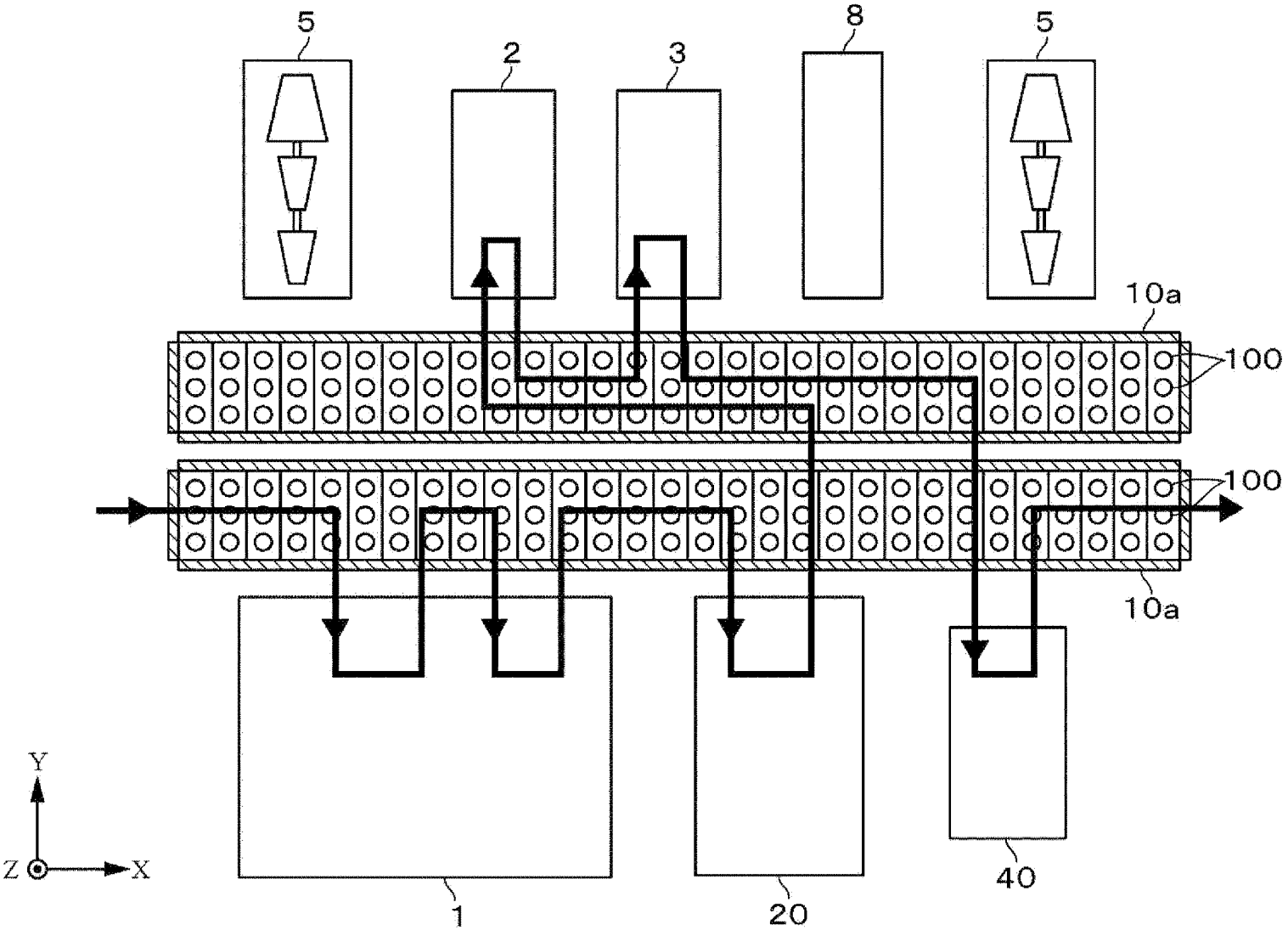
FIG. 7 is a plan view for illustrating an NG liquefying apparatus in a comparative example.

Features of arrangement of the gas turbine compressors 9 and the treatment units (the precooling unit 2, the liquefying unit 3, and the refrigerant cooling unit 8) in the NG liquefying apparatus according to the above-mentioned embodiment are described in comparison with an arrangement example of an NG liquefying apparatus in a comparative example illustrated in FIG. 7. In the NG liquefying apparatus in the comparative example, along a long side of one pipe rack 10*a*, the precooling unit 2, the liquefying unit 3, and the refrigerant cooling unit 8 that are the treatment units are arranged side by side. Moreover, along the line of the treatment units (the precooling unit 2, the liquefying unit 3, and the refrigerant cooling unit 8), the two gas turbine compressors 9 that form the compression units 5 are arranged such that the treatment units are placed between the two gas turbine compressors 9. Further, the other hot section 1, the heavy-component removing unit 20, and the end flash unit 40 are arranged in the stated order along a long side of another pipe rack 10*a*.

As described above, in the NG liquefying apparatus in the comparative example illustrated in FIG. 7, the treatment units (the precooling unit 2, the liquefying unit 3, and the refrigerant cooling unit 8), which use the precooling refrigerant and the liquefying refrigerant and are configured to treat (compress and cool) the precooling refrigerant and the liquefying refrigerant, and the gas turbine compressors 9 are arranged along the pipe rack 10*a* in a distributed manner. In this case, it is required that pipes through which the refrigerants are transferred among the units be also arranged in a direction of the long side of the pipe rack 10*a*.

In a large-sized NG liquefying apparatus, in some cases, the long side of the pipe rack 10*a* is equal to or larger than 100 meters. In some other cases, pipes through which the precooling refrigerant and the liquefying refrigerant are allowed to flow include a large-diameter pipe having a diameter of several tens of inches in some cases. Accordingly, arrangement of the large-diameter pipe over a long length leads to increase in amounts of pipe materials to be used.

Therefore, in the NG liquefying apparatus according to this embodiment, as illustrated in FIG. 1 and FIG. 2, the first arrangement region 7A, which is the region in which the two gas turbine compressors 9 and the refrigerant cooling unit 8 are arranged, and the second arrangement region 7B, which is the region in which the precooling unit 2 and the liquefying unit 3 are arranged, are arranged so as to be opposed to each other across the long sides of the pipe racks 10. With this arrangement, as illustrated in FIG. 2, the crossing pipes 201*a*, which are large-diameter pipes through which the precooling refrigerant and the liquefying refrigerant are allowed to flow, can be arranged in a direction of short sides of the pipe racks 10. Accordingly, the amounts of pipe materials to be used can be significantly reduced as compared to those in the comparative example illustrated in FIG. 7.

Meanwhile, as illustrated in FIG. 3, on the stories of the pipe rack 10, the large number of pipes 201, through which the fluids to be transferred among the devices of the NG liquefying apparatus are allowed to flow, are arranged in a length direction of the pipe rack 10. In order that, in a region in which the pipes 201 are thus to be arranged along the direction of the long side of the pipe rack 10, the large-diameter crossing pipes 201*a* are arranged so as to cross extending directions of the pipes 201, it is required to avoid interference between the pipes 201 and the pipes 201*a*.

Accordingly, it is inevitable that the crossing pipes 201*a*, which are to be arranged so as to cross the pipes 201, be arranged, for example, above the pipes 201. As a result, in order to secure a space in which the large-diameter crossing pipes 201*a* are to be arranged, it is required to secure a sufficient height for each story of the pipe rack 10. Accordingly, a height of the entire pipe rack 10 is increased, and hence there is a fear in that amounts of framework forming materials to be used is increased.

Accordingly, as illustrated in FIG. 1 to FIG. 3, in the NG liquefying apparatus according to this embodiment, each pipe rack 10 interposed between the first arrangement region 7A and the second arrangement region 7B has a region (non-arrangement region 101) in which no ACHE 100 is arranged. Through use of the non-arrangement region 101, the plurality of crossing pipes 201*a*, through which the precooling refrigerant and the liquefying refrigerant are allowed to flow, are arranged in a region different in height from the stories on which the pipes 201 are arranged along the long side of the pipe rack 10.

In the example illustrated in FIG. 3, in the non-arrangement region 101, the crossing pipes 201*a* are separately arranged in a plurality of stages (two stages in the example illustrated in FIG. 3) within a height range corresponding to a range from a cooling-air intake space (space on a lower side of the ACHEs 100) to arrangement positions of the ACHEs 100 in the region in which the ACHEs 100 are arranged.

As a matter of course, the crossing pipes 201*a*, through which fluids other than the precooling refrigerant and the liquefying refrigerant are allowed to flow, may be arranged in the non-arrangement region 101.

With the above-mentioned configuration, without increasing the height of the entire pipe rack 10, a space for arrangement of the crossing pipes 201*a* in the direction of the short side of the pipe rack 10 can be secured. By a length of the non-arrangement region 101, the pipe rack 10 is increased in length in the direction of the long side of the pipe rack 10 in some cases. However, the increase in amounts of framework forming materials to be used is suppressed as compared to a case of increasing the height of the entire pipe rack 10.

Meanwhile, with the opposed arrangement of the first arrangement region 7A and the second arrangement region 7B across the pipe racks 10, the amounts of pipe materials to be used can be significantly reduced. Accordingly, the NG liquefying apparatus has a configuration capable of reducing amounts of materials to be used as a whole. As a result, an amount of construction work during construction of the NG liquefying apparatus can be reduced, which leads to further reduction in construction cost.

Further, in the example illustrated in FIG. 3, a top plate 102 configured to cover the crossing pipes 201*a* from the upper surface side of the pipe rack is provided in the non-arrangement region 101. Owing to arrangement of the top plate 102, there can be prevented occurrence of hot air recirculation (HAR) that is caused when the high-temperature air discharged from the ACHEs 100 is taken in from a lower surface side of the ACHEs 100 via the non-arrangement region 101, and degrades cooling performance of the ACHEs 100.

Moreover, in order to prevent occurrence of the HAR, a side plate may be provided in the non-arrangement region 101. The side plate is configured to partition a side plane of the non-arrangement region 101 from the ACHEs 100 and the cooling-air intake space below the ACHEs 100.

According to the NG liquefying apparatus according to this embodiment having the features described above, the first arrangement region 7A and the second arrangement region 7B, in which the treatment units (the precooling unit 2, the liquefying unit 3, and the refrigerant cooling unit 8) and the gas turbine compressors 9 to be connected to each other via the large-diameter crossing pipes 201*a* are arranged, are arranged so as to be opposed to each other across the pipe racks 10. With this arrangement, an installation length of the large-diameter crossing pipes 201*a* can be reduced.

Moreover, each pipe rack 10 has the region in which no ACHE 100 is arranged (non-arrangement region 101), and the above-mentioned large-diameter crossing pipes 201*a* are arranged so as to cross the non-arrangement region 101. With this configuration, the increase in height of the overall pipe rack 10 can be suppressed.

Here, the treatment unit to be arranged in the first arrangement region 7A is not limited to the refrigerant cooling unit 8 in the example illustrated in FIG. 2.

For example, the precooling unit 2 or the liquefying unit 3 may be arranged on the first arrangement region 7A side. In this case, the liquefying unit 3 and the refrigerant cooling unit 8, or alternatively the precooling unit 2 and the refrigerant cooling unit 8 are arranged in the second arrangement region 7B.

Figure 4:
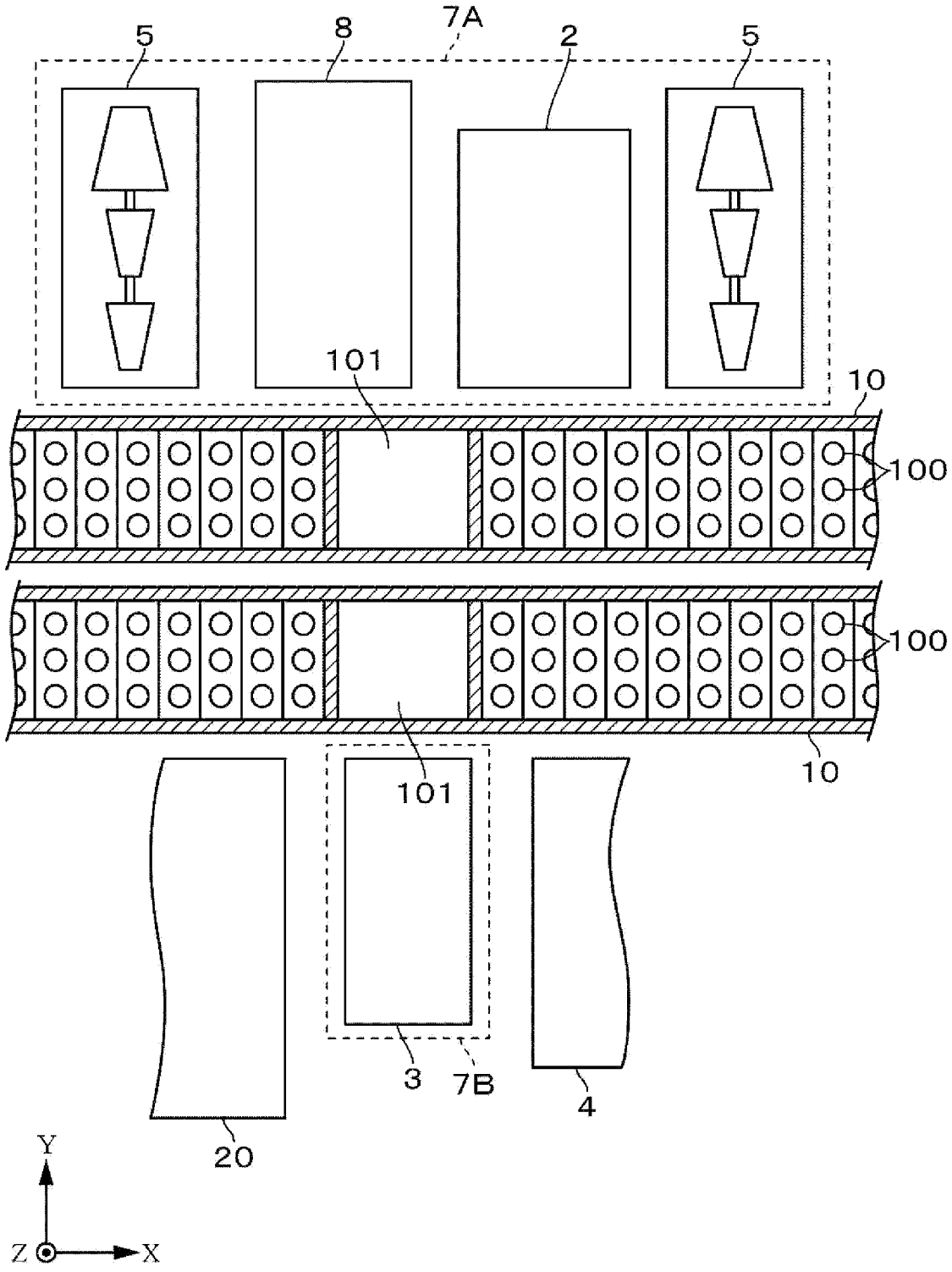
FIG. 4 is a plan view for illustrating another example of the NG liquefying apparatus.

Alternatively, as illustrated in FIG. 4, on the first arrangement region 7A side on which the treatment unit is to be arranged together with the gas turbine compressors 9, there may be arranged two treatment units (the refrigerant cooling unit 8 and the precooling unit 2 in the example illustrated in FIG. 4) selected from a treatment unit group consisting of the precooling unit 2, the liquefying unit 3, and the refrigerant cooling unit 8. In this case, the other treatment unit (the liquefying unit 3 in the example illustrated in FIG. 4) is arranged on the second arrangement region 7B side.

Figure 5:
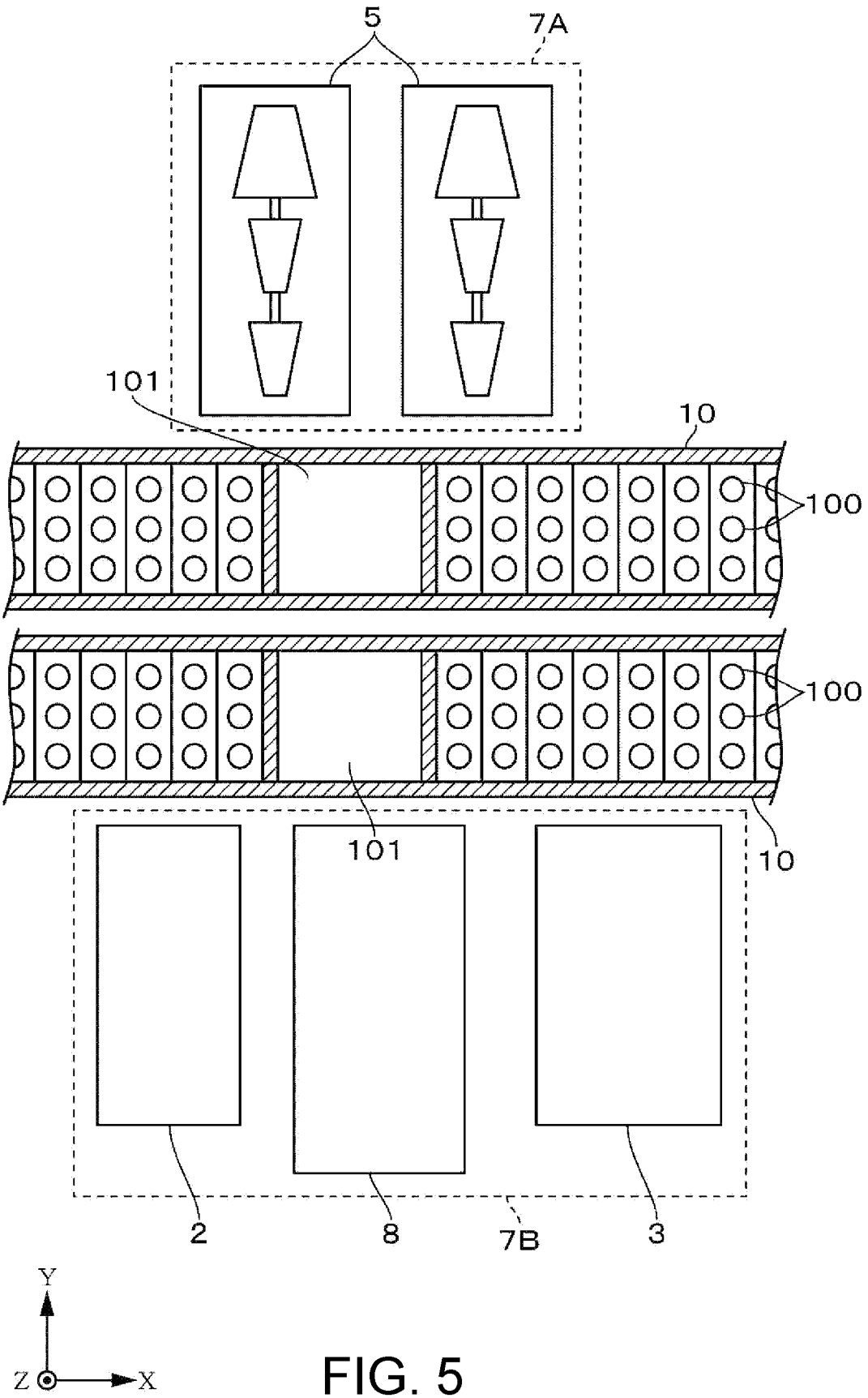
FIG. 5 is a plan view for illustrating still another example of the NG liquefying apparatus.

Moreover, as still another example, as illustrated in FIG. 5, only the gas turbine compressors 9 that form the compression units 5 may be provided in the first arrangement region 7A. In this case, the precooling unit 2, the refrigerant cooling unit 8, and the liquefying unit 3 (all of the treatment units that are not arranged in the first arrangement region 7A) are arranged in the second arrangement region 7B.

Figure 6:
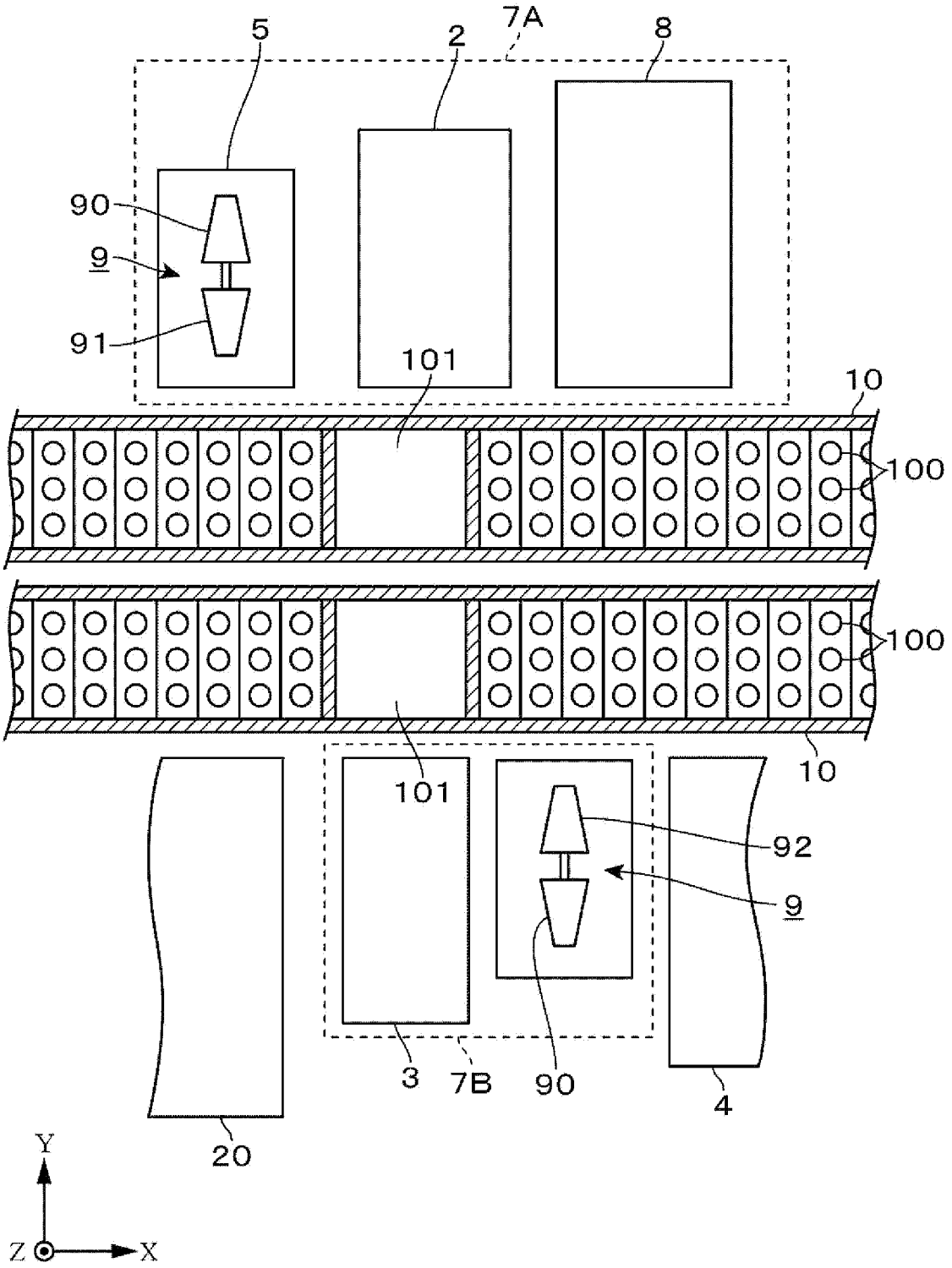
FIG. 6 is a plan view for illustrating still another example of the NG liquefying apparatus.

Further, FIG. 6 is an illustration of an example, which is an example different from the above-mentioned examples, in which the driver 90 configured to drive the first compressor 91, and the driver 90 configured to drive the second compressor 92 are provided individually. In this case, the compression unit 5 including the first compressor 91, and the compression unit 5 including the second compressor 92 may be provided separately from each other. As a result, as illustrated in FIG. 6, there may also be adopted a configuration in which the compression unit 5 including the first compressor 91, and the precooling unit 2 are arranged in the first arrangement region 7A, and in which the compression unit 5 including the second compressor 92, and the liquefying unit 3 are arranged in the second arrangement region 7B. In this case, the refrigerant cooling unit 8 may be provided in any one of the first arrangement region 7A and the second arrangement region 7B (in the example illustrated in FIG. 6, the refrigerant cooling unit 8 is provided on the first arrangement region 7A side).

In the same manner as that in the example illustrated in FIG. 2, also in FIG. 4 to FIG. 6, the crossing pipes 201*a* through which the precooling refrigerant and the liquefying refrigerant are allowed to flow are provided in the non-arrangement region 101 in the direction of the short sides of the pipe racks 10. However, for convenience of illustration, illustrations of the crossing pipes 201*a* are omitted.

It is only required that at least a part of the first arrangement region 7A and at least a part of the second arrangement region 7B be opposed to each other across the pipe racks 10. The non-arrangement region 101 is provided in a region of each pipe rack 10 including a position between the first arrangement region 7A and the second arrangement region 7B.

Further, in the NG liquefying apparatus in the above-mentioned examples of the embodiment of the present invention, depending on, for example, an amount of the NG to be treated and an LNG rundown temperature, installation of the subcooling unit 4, the compressor 41, and the end flash unit 40 may be omitted as appropriate.

Further, combination examples of refrigerants to be used in the NG liquefying apparatus are not limited to the above-mentioned examples. A mixed refrigerant obtained by mixing, for example, methane, ethane, propane, and butane may also be used as the precooling refrigerant. When the subcooling unit 4 is omitted as described above, the subcooling refrigerant is not used.

What is claimed is:

1. A natural gas liquefying apparatus for liquefying natural gas, comprising:

a precooling unit, which is a treatment unit including a precooling heat exchanger configured to precool, through use of a precooling refrigerant, the natural gas supplied to the natural gas liquefying apparatus;

a liquefying unit, which is a treatment unit including a liquefying heat exchanger configured to liquefy the precooled natural gas through use of a liquefying refrigerant;

a compression unit including:

a first compressor configured to compress the vaporized precooling refrigerant; and a second compressor configured to compress the vaporized liquefying refrigerant;

a pipe rack, which is a framework structure having a rectangular shape in top view, and is configured to retain a plurality of pipes through which a fluid to be treated in the natural gas liquefying apparatus is allowed to flow, the pipe rack including a plurality of air-cooled coolers arrayed and arranged on an upper surface of the pipe rack, the plurality of air-cooled coolers being configured to cool a fluid to be cooled that includes the precooling refrigerant compressed by the first compressor, and the liquefying refrigerant compressed by the second compressor;

a refrigerant cooling unit, which is a treatment unit including a refrigerant cooling heat exchanger configured to cool, through use of the precooling refrigerant, the liquefying refrigerant cooled by the plurality of air-cooled coolers; and a top plate configured to cover the plurality of pipes from an upper surface side of the pipe rack, wherein the treatment units and the compression unit are arranged in a first arrangement region and a second arrangement region with any one of combinations (a), (b), and (c):

(a) the compression unit and at least one treatment unit selected from a treatment unit group consisting of the precooling unit, the liquefying unit, and the refrigerant cooling unit are arranged in the first arrangement region, and the other treatment units that are not arranged in the first arrangement region are arranged in the second arrangement region;

(b) the compression unit is arranged in the first arrangement region, and the precooling unit, the liquefying unit, and the refrigerant cooling unit are arranged in the second arrangement region; and (c) the first compressor of the compression unit, a driver for the first compressor, and the precooling unit are arranged in the first arrangement region, the second compressor of the compression unit, a driver for the second compressor, and the liquefying unit are arranged in the second arrangement region, and the refrigerant cooling unit is arranged in any one of the first arrangement region and the second arrangement region, wherein at least a part of the first arrangement region and at least a part of the second arrangement region are arranged so as to be opposed to each other across a long side of the rectangular shape of the pipe rack, and wherein the pipe rack interposed between the first arrangement region and the second arrangement region has a region in which no air-cooled cooler is arranged in order to arrange a plurality of pipes, through which one of the precooling refrigerant and the liquefying refrigerant is allowed to flow, in a direction of a short side of the rectangular shape of the pipe rack, and the top plate is arranged such that no air-cooled cooler is arranged directly above the top plate.

2. The natural gas liquefying apparatus according to claim 1, wherein, in the region in which no air-cooled cooler is arranged, the plurality of pipes are separately arranged in a plurality of stages within a height range corresponding to a range from a lower end of a cooling-air intake space to a top end of arrangement positions of the plurality of air-cooled coolers in a region in which the plurality of air-cooled coolers are arranged, and the cooling-air intake space is a space on a lower side of the air-cooled coolers.

3. The natural gas liquefying apparatus according to claim 1, wherein when the combination in the first arrangement region and the second arrangement region satisfies one of the combination (a) and the combination (b), the first compressor and the second compressor are configured to be driven by a shared driver.

4. The natural gas liquefying apparatus according to claim 3, wherein when the combination in the first arrangement region and the second arrangement region satisfies the combination (a), two compression units are provided, and the two compression units are arranged such that the at least one treatment unit arranged in the first arrangement region is placed between the two compression units.

* * * * *